US007987930B2

(12) United States Patent
Purcell

(10) Patent No.: US 7,987,930 B2
(45) Date of Patent: Aug. 2, 2011

(54) DRILL BIT ASSEMBLY FOR FLUID-OPERATED PERCUSSION DRILL TOOLS

(75) Inventor: Joseph Purcell, County Clare (IE)

(73) Assignee: Minroc Technical Promotions Limited, Co. Clare (IE)

( * ) Notice: Subject to any disclaimer, the term of this patent is extended or adjusted under 35 U.S.C. 154(b) by 571 days.

(21) Appl. No.: 11/988,900

(22) PCT Filed: Jul. 20, 2006

(86) PCT No.: PCT/IE2006/000075

§ 371 (c)(1), (2), (4) Date: Jan. 16, 2008

(87) PCT Pub. No.: WO2007/010513

PCT Pub. Date: Jan. 25, 2007

(65) Prior Publication Data

US 2010/0108395 A1 May 6, 2010

(30) Foreign Application Priority Data

Jul. 20, 2005 (IE) ..... S2005/0495

(51) Int. Cl.
*E21B 4/14* (2006.01)

(52) U.S. Cl. ..... 175/296; 175/306; 173/90

(58) Field of Classification Search ..... 175/296, 175/306; 173/90
See application file for complete search history.

(56) References Cited

U.S. PATENT DOCUMENTS 2,613,647 A * 10/1952 Curtis ..... 173/63
3,227,230 A * 1/1966 Lagerstrom ..... 175/214
3,299,971 A * 1/1967 Lewis ..... 175/92
3,311,177 A 3/1967 Collier et al.
3,712,388 A 1/1973 Curington ..... 173/78
3,735,820 A 5/1973 Curington ..... 173/78
3,871,486 A * 3/1975 Curington et al. ..... 175/100
4,212,359 A 7/1980 Adcock ..... 175/26
4,705,118 A * 11/1987 Ennis ..... 175/65

(Continued)

FOREIGN PATENT DOCUMENTS

GB 1213167 11/1970

(Continued)

*Primary Examiner* — Shane Bomar
*Assistant Examiner* — Elizabeth C Gottlieb
(74) *Attorney, Agent, or Firm* — Kusner & Jaffe

(57) ABSTRACT

The invention relates to a drill bit assembly for fluid-operated percussion drill tools comprising a percussion bit (1) having a head portion (3) formed with an axially extending stub shank (32). The stub shank is provided with axially extending splines (36), which are slideably engageable with complementary splines (35) formed on a drive chuck (4). Rotational drive from the chuck (4) may be transmitted to the stub shank (32) by means of the splines. Bit retaining means (6, 7, 41, 42) at the chuck are adapted for engagement with complementary retaining means (37, 51) at a spline portion of the stub shank to retain the stub shank in the drill bit assembly. Engagement means on the chuck (4) are adapted for connecting the chuck (4) to a drive means (5) of the fluid-operated percussion drill tool. The invention also relates to a down-the-hole hammer comprising an external cylindrical outer wear sleeve (5), a sliding piston (8) mounted for reciprocating movement within the outer wear sleeve (5) to strike a percussion bit (1) of a drill bit assembly located at the forward end of the outer wear sleeve (5) wherein the drill bit assembly is an assembly as described above.

8 Claims, 9 Drawing Sheets

U.S. PATENT DOCUMENTS 4,726,429 A * 2/1988 Kennedy ..... 173/62
4,765,418 A * 8/1988 Ennis ..... 175/396
4,924,948 A * 5/1990 Chuang et al. ..... 173/211
5,009,271 A * 4/1991 Maric et al. ..... 175/53
5,407,021 A * 4/1995 Kane et al. ..... 175/296
5,685,380 A * 11/1997 Purcell et al. ..... 175/215
6,637,520 B1 * 10/2003 Purcell ..... 173/91
6,705,415 B1 * 3/2004 Falvey et al. ..... 175/74
7,290,626 B2 * 11/2007 Terlet et al. ..... 175/296
7,467,675 B2 * 12/2008 Lay ..... 175/296

FOREIGN PATENT DOCUMENTS

GB 2296731 7/1996
WO WO 98/05476 2/1998

* cited by examiner

DRILL BIT ASSEMBLY FOR FLUID-OPERATED PERCUSSION DRILL TOOLS

TECHNICAL FIELD OF THE INVENTION

The present invention relates to a drill bit assembly for fluid-operated percussion drill tools. In particular, the invention concerns a drill bit assembly for use with "down-the-hole" hammers.

BACKGROUND TO THE INVENTION

Some designs of conventional down-the-hole hammers and fluid-operated percussion drill tools comprise an external cylinder or outer wear sleeve, within which is mounted an inner cylinder which in turn engages with a backhead assembly. A sliding reciprocating piston co-operates with the inner cylinder and backhead assembly, which when air pressure is supplied through the backhead assembly, acts with a percussive effect on a drill bit retained within a chuck on the outer wear sleeve.

Typically the inner cylinder is mounted co-axially within the outer wear sleeve. A sliding piston is mounted for reciprocating movement within the inner cylinder and the outer wear sleeve, to strike a hammer bit mounted for sliding movement in a chuck located at the forward end of the outer wear sleeve, in well known manner. A foot valve is positioned above the bit.

Our prior patent application Publication No. WO 2004/013530, discloses a down-the-hole hammer in which the bit has an elongate shank portion which at its upper end has an annular strike face (or anvil) against which the piston impacts to impart a percussive force to the bit. A lower end of the bit shank is formed externally with a plurality of splines which are spaced around the circumference of the bit shank and extend in the axial direction. The splines slideably engage with complementary splines formed on the internal wall of an annular chuck. The chuck is screw-threadably connected to the bottom of the outer wear sleeve. The bit is retained in the hammer assembly by means of a bit retaining ring, which sits above the chuck and cooperates with an annular shoulder on the bit. This prevents the bit from falling out of the assembly in operation.

In operation the bit shank comes under forces due to the percussive action of the hammer, and rotational torque which is provided by the chuck. This imparts significant bending moments on the upper part of the bit shank increasing the risk of breakage of the shank due to cracking. Drill bits are very expensive to produce, and to recover if they are lost down the drilling hole. That this is a significant problem with the drill bits of conventional down-the-hole hammers is evidenced by the fact that there are a number of patents directed to means of retaining a broken-off bit within the bit assembly so as to prevent it falling down the drill hole. Examples of these patents are U.S. Pat. Nos. 5,065,827, 4,003,442, WO 96/15349, WO 98/05476, WO 03/062585, WO 03/062586.

However, the inventions disclosed in these patents are directed to dealing with problems which occur after the bit shaft has fractured, and not to preventing the breakage in the first place.

Other disadvantages associated with conventional percussion drill tools, such as down-the-hole hammers, is that the bit has a long shank portion which is expensive to produce. The long shank portion is required in order to provide a splined shank portion of sufficient length to give enough support for transfer of rotational torque, and an area above the splines for retaining the bit. In conventional hammers, when the bit head or cutting face is worn out, the shank can often be in good condition but because it is made integral with the cutting face, it must be discarded. The premature wearing out of the head/cutting face may occur where drilling is carried out in very abrasive rock or material which wears the tungsten carbide inserts in the cutting head. With many conventional hammers, there is a need to provide foot valves in the bit. The foot valve is required as an integral part of the functioning of the hammer i.e. when the piston is in the strike position, the bottom lift chamber is sealed by the bore of the piston and the outside of the footvalve. If this were not the case then the piston would not lift. The footvalve is prone to occasional breakage leading to down-time.

OBJECT OF THE INVENTION

It is an object of the invention to provide a bit mounting system for a down-the-hole hammer, or other fluid operated percussion drill tool which avoids many of the disadvantages of the prior art systems as described above. It is also an object of the invention to provide a bit system in which the shank is shorter in length than conventional drill shanks. It is also an object of the invention to provide an improved coupling means for the bit assembly.

SUMMARY OF THE INVENTION

In a first aspect, the invention provides a drill bit assembly for fluid-operated percussion drill tools comprising: a percussion bit having a head portion formed with an axially extending stub shank, axially extending splines on the stub shank slideably engageable with complementary splines formed on a drive chuck whereby rotational drive from the chuck may be transmitted to the stub shank, bit retaining means at the chuck adapted for engagement with complementary retaining means at a spline portion of the stub shank to retain the stub shank in the drill bit assembly, and engagement means on the chuck adapted for connecting the chuck to a drive means of the fluid-operated percussion drill tool.

Preferably, the drive chuck is formed with a screw thread which is adapted to engage with a complementary screw thread on the lower end of a wear sleeve of the drill tool. Suitably, the axially extending splines are formed on an external cylindrical wall of the stub shaft and engage with complementary splines formed internally of the drive chuck.

Suitably, the bit retaining means comprises at least one, but preferably a plurality of apertures through the wall of the drive chuck and a corresponding plurality of bit retaining pieces; such that when the bit assembly is assembled, the bit retaining pieces are received in the apertures and engage with the complementary retaining means at the spline portion of the stub shank to retain the stub shank in the drill bit assembly.

According to a first embodiment of the invention, the apertures are formed as part-annular slots through the wall of the drive chuck and the bit retaining pieces are part-annularly shaped and the complementary retaining means comprises an annular shoulder formed at an upper end of the stub shank; such that when the bit assembly is assembled, the part-annular bit retaining pieces are received in the part-annular slots and engage with the underside of the annular shoulder to retain the stub shank in the drill bit assembly.

According to an alternative embodiment, the apertures are formed as substantially circular openings through the wall of the drive chuck and the bit retaining pieces are ball nose pins and the complementary retaining means comprises a plurality of recesses formed at an upper end of the stub shank; such that when the bit assembly is assembled, the ball nose pins are received in the circular openings and engage with upper internal walls of the recesses to retain the stub shank in the drill bit assembly.

In one embodiment, at least one of the recesses at the upper end of the stub shank is formed entirely within a spline on the stub shank. Preferably, each recess is formed entirely within a respective one of the splines on the stub shank.

In another aspect, the invention provides a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, in which the drill bit assembly is as described above.

The hammer may be a conventional down-the-hole hammer or a reverse circulation down-the-hole hammer.

The drill bit assembly of the invention has a number of advantages over conventional systems. Because the means to retain the bit within the chuck has been moved to the splined portion of the stub shank, the present invention allows for a shortened shank. In addition, splined support for transfer of rotational torque is provided both above and below the bit retaining means. Where the complementary retaining means comprises a plurality of recesses, each of which is formed entirely within one of the splines on the stub shank, splined support for transfer of rotational torque is provided over the entire length of the splines.

The short stub shaft is less expensive to manufacture than bit heads having long shafts. The stub shank suffers much less from bending forces due to its shorter length and is thus less prone to bending failures associated with longer shanks used in conventional percussion drill tools. As an analogy, when using a manual hammer, a long nail is much more likely to bend than a short nail. As a result, the shortened shank is much stronger than conventional bit shanks.

Another advantage is that it is much cheaper to replace the bit in abrasive conditions, as compared to conventional drill bit assemblies where the bit head has an attached long shaft. The short stub shank requires substantially less material than conventional long bit shanks. Furthermore, with the assembly of the invention there is no need to have a footvalve in the bit. The footvalve and piston cooperation of the prior art may be replaced in the invention by the nose of the piston 8 sealing in the bore of bushing 2. Nevertheless, it is optional whether a footvalve is used or not.

BRIEF DESCRIPTION OF THE DRAWINGS

Two embodiments of a down-the-hole hammer having a bit coupling system in accordance with the invention will now be described with reference to the accompanying drawings, wherein.

DETAILED DESCRIPTION OF THE DRAWINGS

Figures 1, 2, 3:
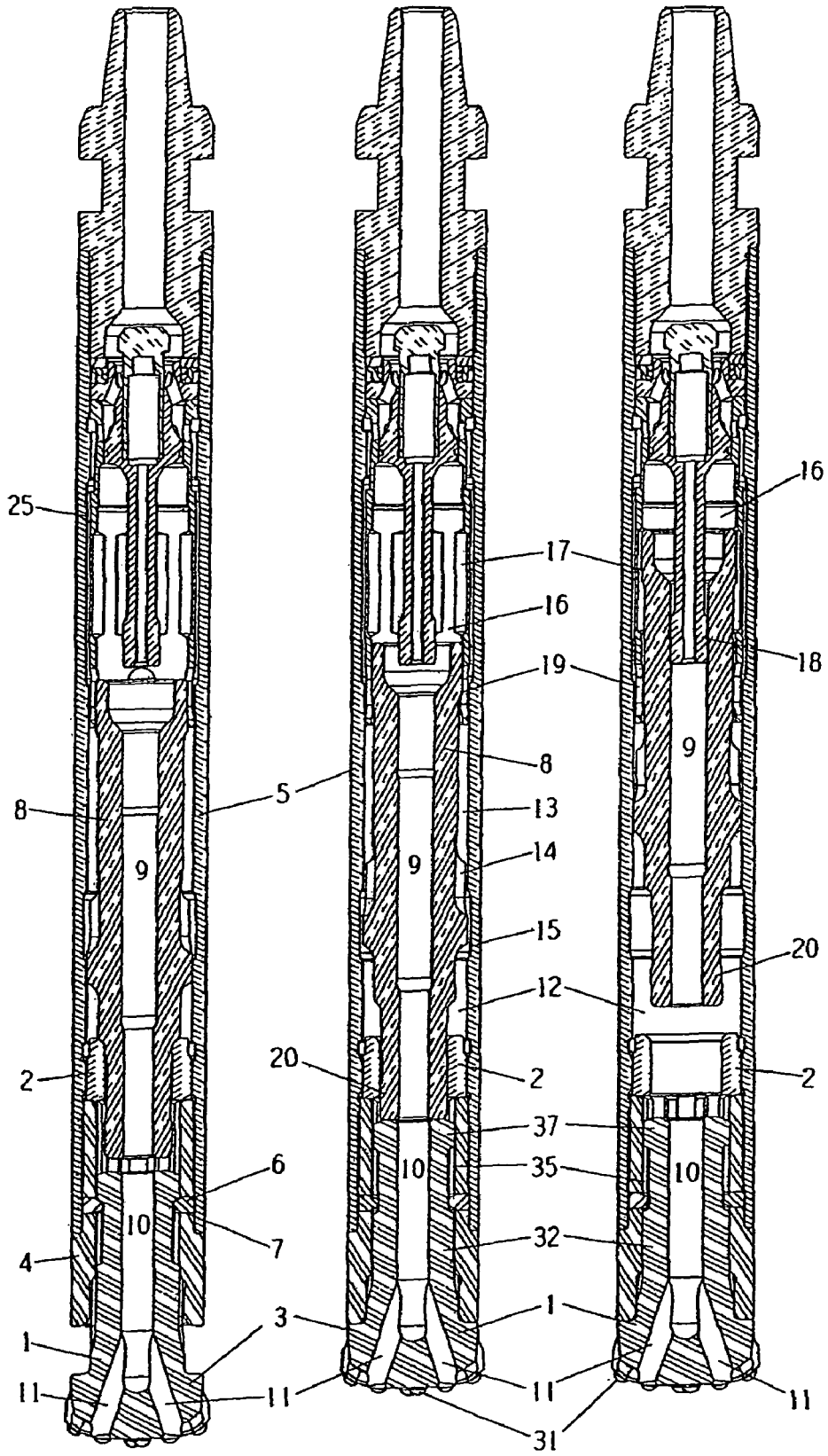
FIG. 1 is a sectional side elevation of a down-the-hole hammer according to a first embodiment of the invention, showing the piston in an off-bottom position.
FIG. 2 is a sectional side elevation of the down-the-hole hammer of FIG. 1, showing the piston in the strike position.
FIG. 3 is a sectional side elevation of the down-the-hole hammer of FIG. 1, showing the piston at the top-of-stroke position.

Referring to the drawings, an embodiment of a down-the-hole hammer of the invention comprises an external cylindrical outer wear sleeve 5. An inner cylinder 25 is mounted co-axially within the outer wear sleeve 5. A sliding piston 8 is mounted for reciprocating movement within the inner cylinder and the outer wear sleeve 5, to strike a hammer bit 1 located at the forward end of the outer wear sleeve 5 to exercise a percussive force to the drill bit. Rotational forces are transferred from the rotating outer wear sleeve 5 by means of a chuck 4. The wear sleeve is threadably connected to a drill string which is connected to a rotation motor on a drilling rig at the surface.

Figure 4:
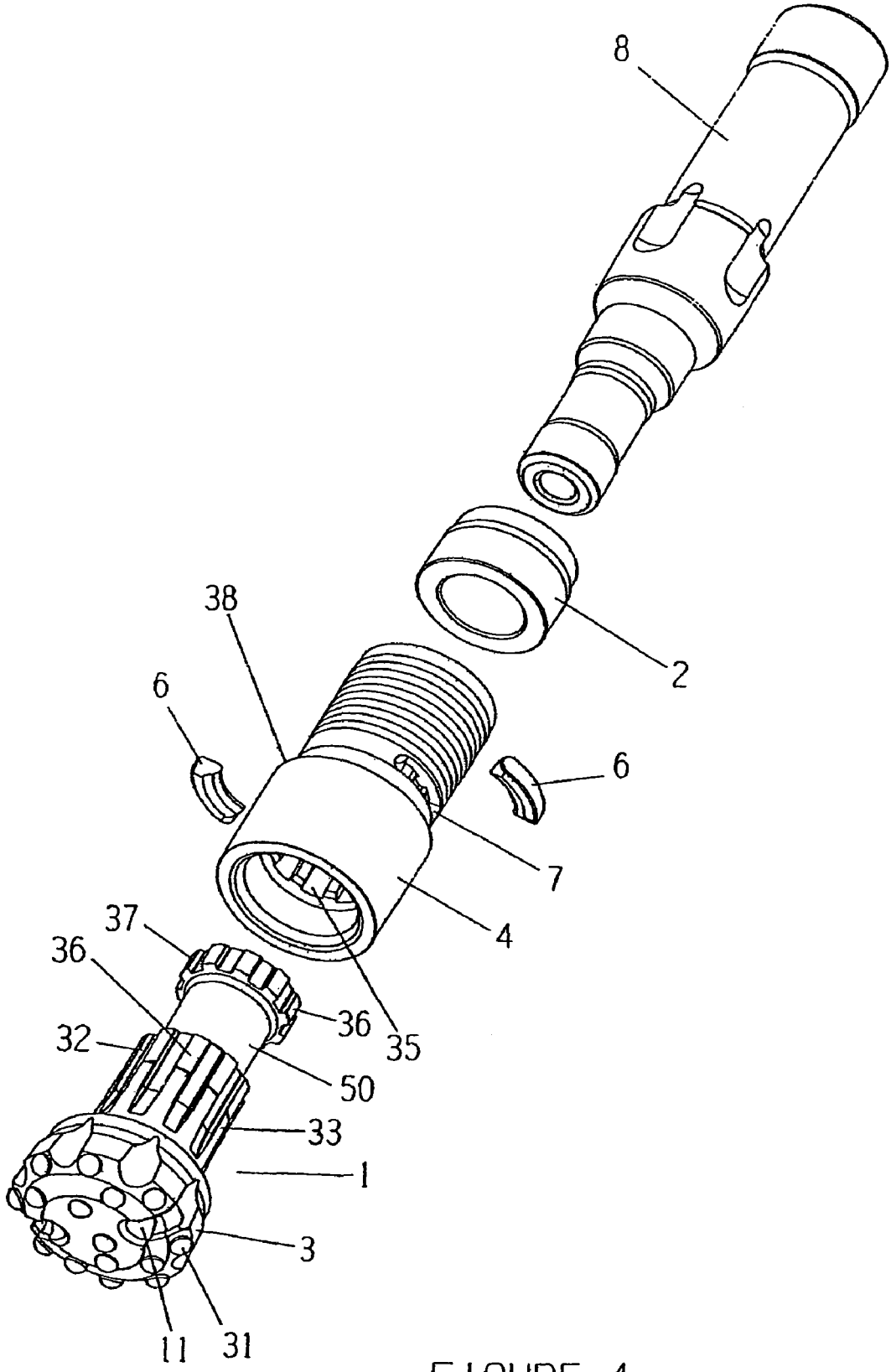
FIG. 4 is an exploded perspective view of the bit coupling system of the invention.
Figure 5:
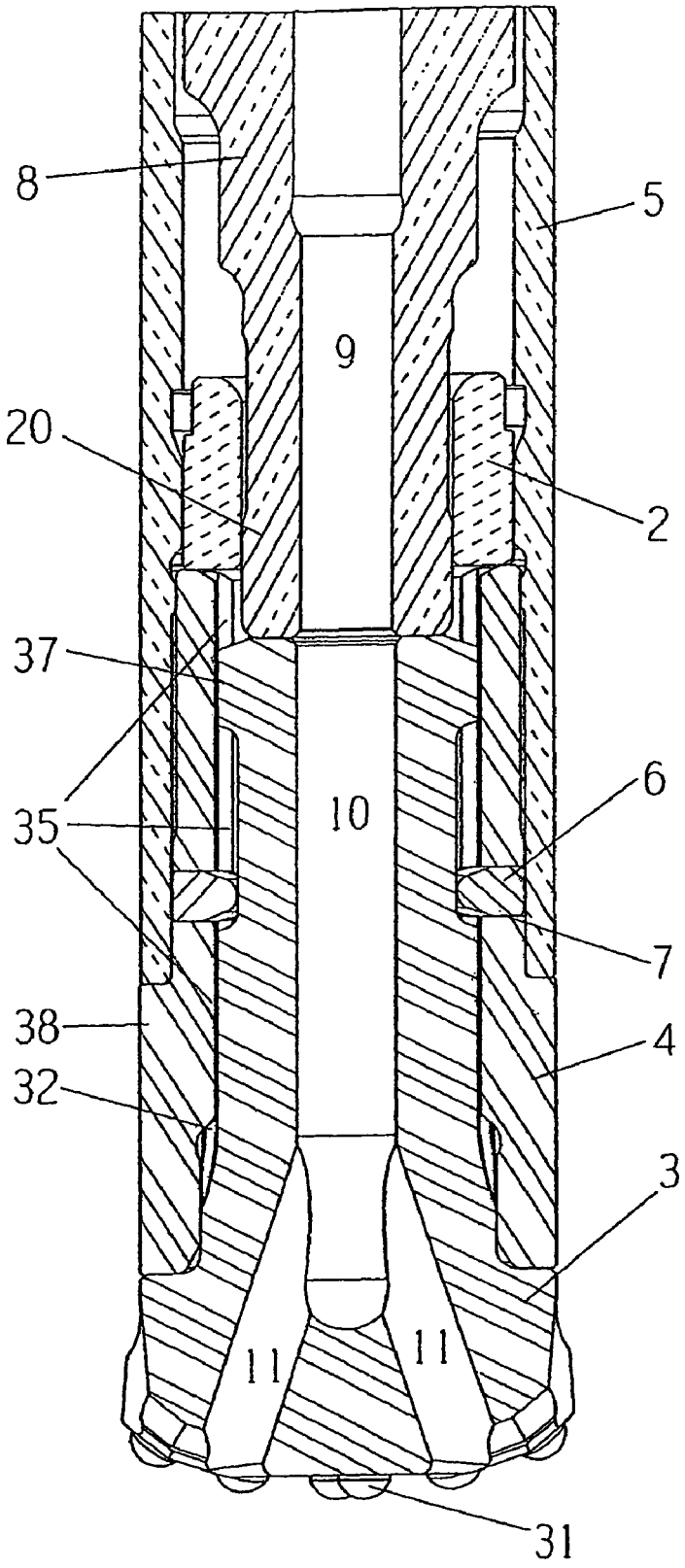
FIG. 5 is an enlarged sectional side elevation substantially of the lower part of FIG. 2.

Referring particularly to FIGS. 4 and 5, the head portion 3 of the bit assembly comprises the percussion bit 1 which is provided with tungsten carbide inserts 31, in a well known manner. The bit head portion 3 is formed with an axially extending stub shank 32. The stub shank 32 is formed with a spline portion, which includes a lower annular shoulder portion 33, an upper annular shoulder portion 37 and an intermediate portion 50. The upper and lower annular shoulder portions 33, 37 are provided with a plurality of axially extending splines 36. The intermediate portion 50 is not provided with splines. Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit.

An upper part of the chuck 4 is externally screw threaded. The chuck 4 is also provided with an external annular shoulder 38, which acts as a stop when the chuck 4 is screwed into the wear sleeve 5 as described below. Above the shoulder 38 a number of part-annular slots 7 are cut or machined through the wall of the chuck 4 to receive part-annular retaining pieces 6. In the assembled bit assembly, the bit retaining pieces 6 engage with the underside of the annular shoulder 37 formed at the top end of the shank 32 to retain the stub shank in the drill bit assembly. The chuck 4 is screwed into the lower end of the wear sleeve 5 and, in doing so retains the bit retaining pieces 6 in slots 7. In addition, the screw threaded engagement of the chuck 4 with the wear sleeve 5 enables rotational torque to be transmitted from the wear sleeve 5 through the chuck 4 to the bit 1.

A reciprocating piston 8 is mounted for reciprocating movement within the inner cylinder 25 and the outer wear sleeve 5 to strike the top face of shoulder 37 to impart a percussive force to the bit. The splines 35 of the chuck 4 slideably engage with the complementary splines 36 on the shank 32 so that the head portion 3 is moved axially relatively to the chuck during the percussive action.

Figure 6:
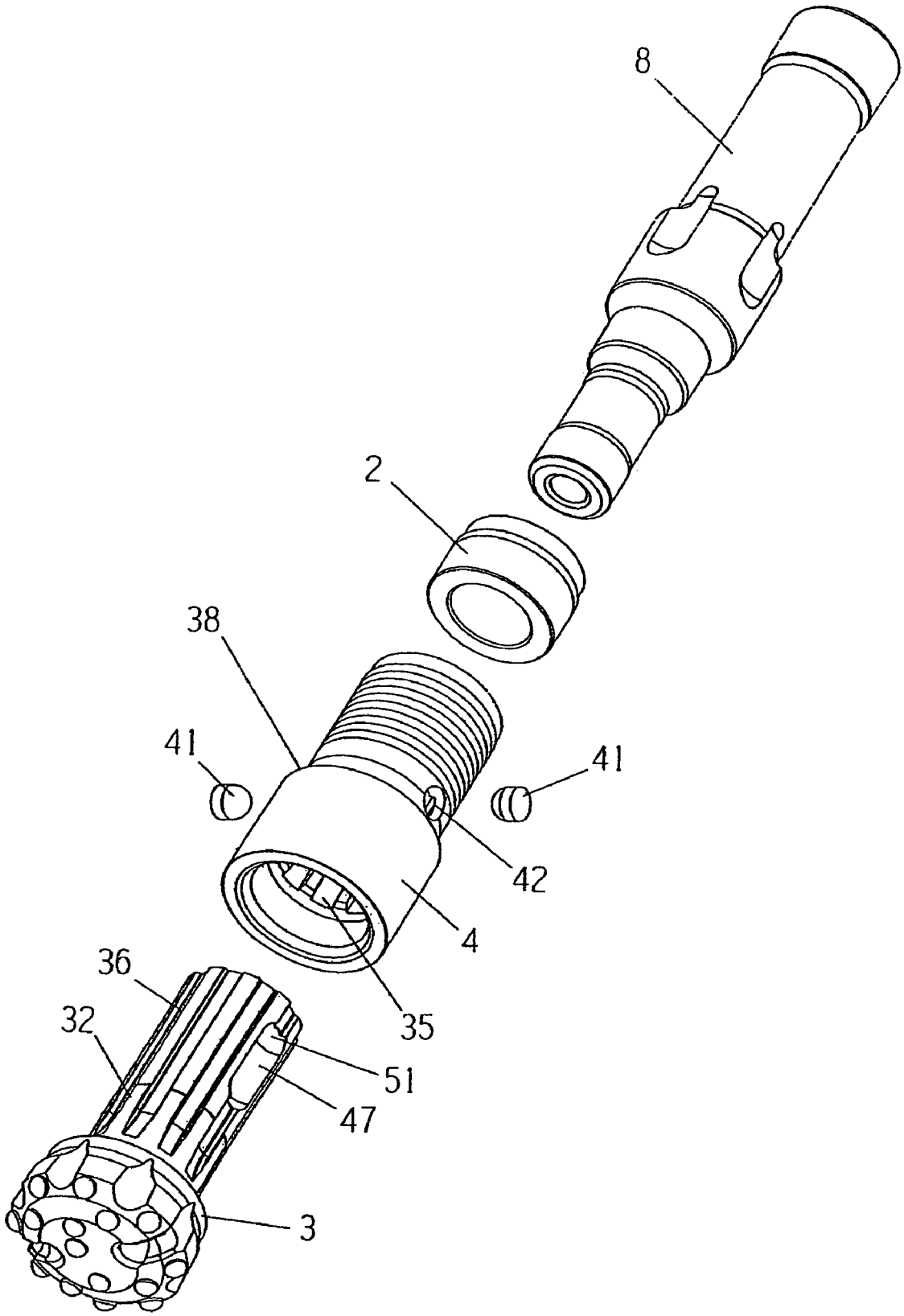
FIG. 6 is an exploded perspective view of a second embodiment of the invention.
Figures 7, 8:
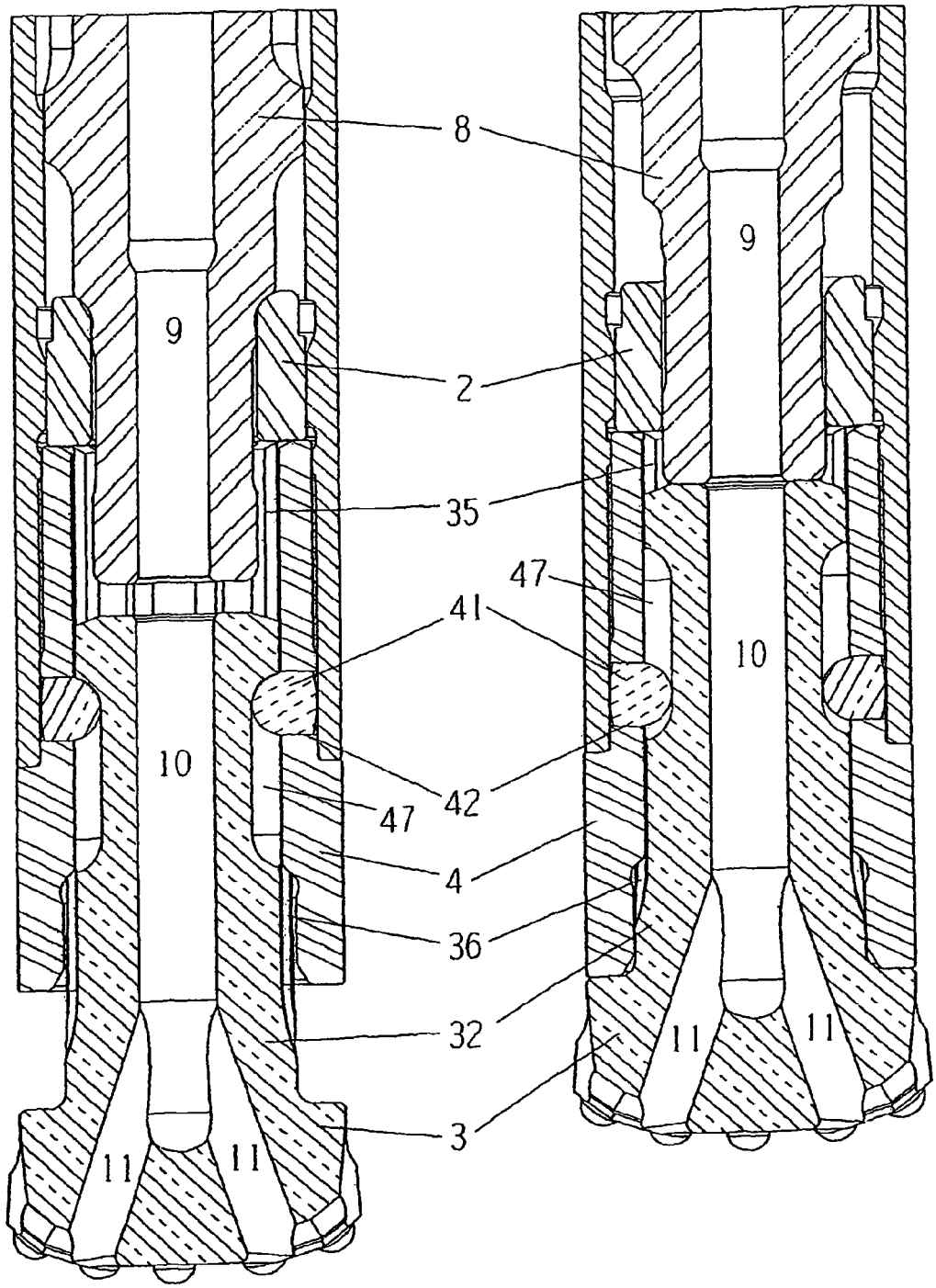
FIG. 7 is an enlarged sectional side elevation of the lower part of a down-the-hole hammer according to the second embodiment of the invention, showing the piston in an off-bottom position.
FIG. 8 is an enlarged sectional side elevation of the lower part of the down-the-hole hammer of FIG. 7, showing the piston in the strike position.

An alternative embodiment of the invention is shown in FIGS. 6, 7 and 8. As before, the head portion 3 of the bit assembly comprises the percussion bit 1 which is provided with tungsten carbide inserts 31, in a well known manner. The bit head portion 3 is formed with an axially extending stub shank 32. The stub shank 32 comprises a spline portion, which is formed with a plurality of axially extending splines 36 and a number of axially extending recesses or millings 47. The recesses 47 are formed with upper internal walls or shoulders 51. Rotational torque is applied to the bit head portion 3 through the chuck 4. The hollow cylindrical chuck 4 is machined internally to provide a plurality of axially extending internal splines 35 on its internal wall which engage with the splines 36 of the shank 32 to transmit rotational drive from the chuck 4 to the drill bit.

Above the shoulder 38 a number of substantially circular openings 42 are cut or machined through the wall of the chuck 4 to receive ball nose pins 41. In the assembled bit assembly, the ball nose pins 41 engage with the upper internal walls or shoulders 51 of the recesses or millings 47 formed at the top end of the shank 32 to retain the stub shank in the drill bit assembly. The chuck 4 is screwed into the lower end of the wear sleeve 5 and, in doing so retains the ball nose pins 41 in openings 42. In addition, the screw threaded engagement of the chuck 4 with the wear sleeve 5 enables rotational torque to be transmitted from the wear sleeve 5 through the chuck 4 to the bit 1.

Figure 9:
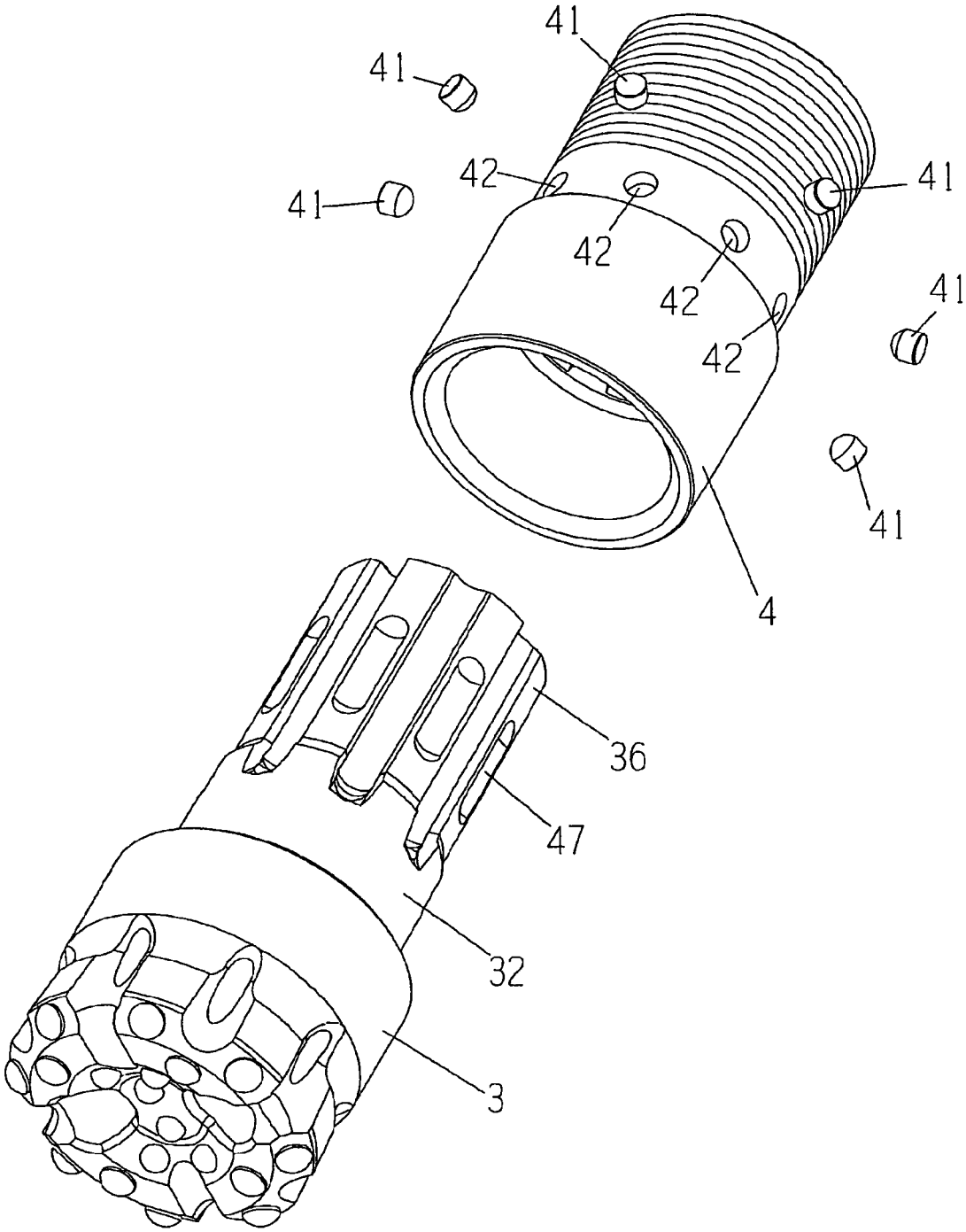
FIG. 9 is an exploded perspective view of a third embodiment of the invention.
Figure 10:
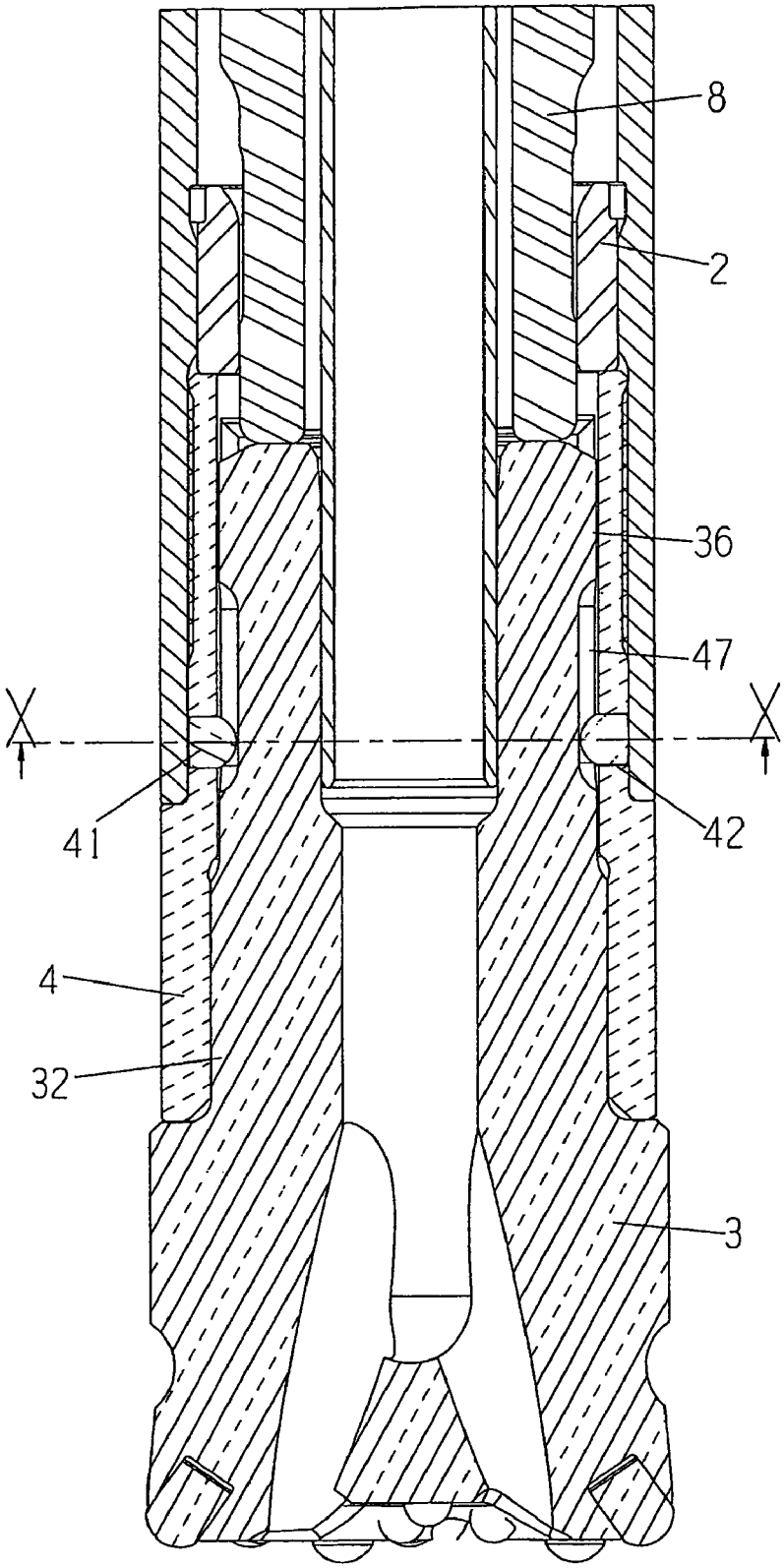
FIG. 10 is a sectional side elevation of the lower part of a down-the-hole hammer according to the third embodiment of the invention, showing the piston in the strike position.
Figure 11:
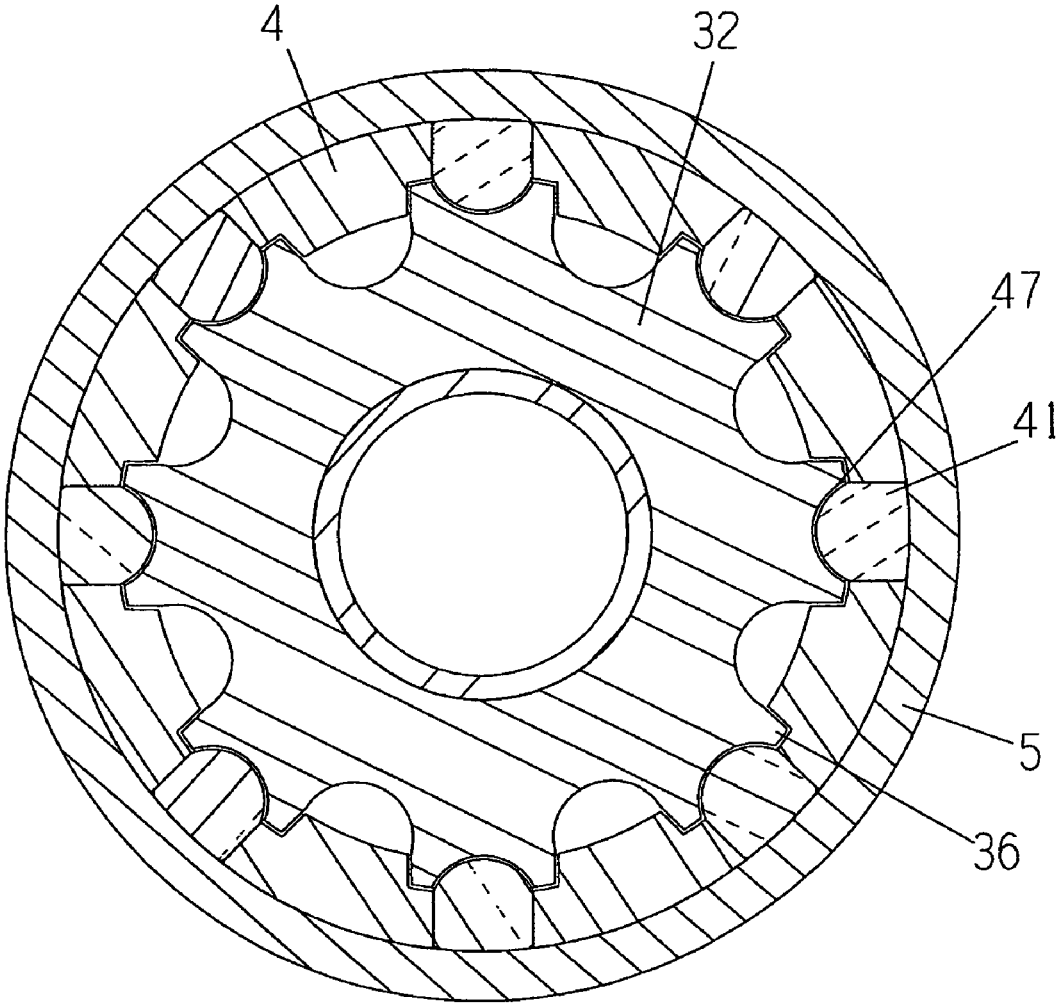
FIG. 11 is a cross sectional view of the down-the-hole hammer of FIG. 10, taken along line X-X.

Yet another embodiment of the invention is shown in FIGS. 9 to 11. In this embodiment, the stub shank 32 comprises a spline portion, which is formed with a plurality of axially extending splines 36 and a number of axially extending recesses or millings 47. Each recess 47 is formed entirely within a respective one of the splines 36 on the stub shank 32. In the embodiment shown in FIGS. 9 to 11, one recess 47 is formed in each spline 36. However, in alternative embodiments, not all of the splines are formed with recesses. As described above with reference to FIGS. 6 to 8, ball nose pins 41 are used to retain the stub shank in the drill bit assembly.

In an embodiment of the invention, which has a nominal 4" hammer which drills hole sizes of 10 cm and greater, the stub shaft 32 has a length in the range 90 mm to 140 mm, preferably about 130 mm. In contrast the long shank portions of conventional down-the-hole hammers, of similar drill size, typically have a length in the range 200 mm to 260 mm. Thus, with the present invention the length of the shaft 32 can be about 30% to 50% less than that of the shafts of conventional down-the-hole hammers.

The hammer cycle is as shown in FIGS. 1 to 3 and FIGS. 7 and 8. FIG. 1 and FIG. 7 show the hammer in the off-bottom position. Piston 8 is permitting exhaust air to flush through bore 9 and bore 10 in bit 1 to the face flushing holes 11. FIG. 2, FIG. 5 and FIG. 8 show the hammer in the strike position. Bushing 2 is provided in the drill assembly in place of a footvalve, to co-operate with piston nose 20. Pressurised air is supplied down chamber 13, through piston grooves 14 and wearsleeve undercut 15, into the pressure chamber 12. This air is sealed off by the piston nose 20 and bushing 2. Simultaneously, the top chamber 16 is open to exhaust through bores 9, 10 and 11. As a result the piston 8 lifts. FIG. 3 shows the piston 8 at the top of stroke. As piston nose 20 is out of contact with bushing 2, lift chamber 12 is open to exhaust through bushing 2 and bores 10, 11. Top chamber 16 is supplied with pressure air through ports 19 and channels 17. The chamber 16, is sealed by the distributor probe 18. As a result the piston is forced down to strike the bit and repeat the cycle.

The arrangement of the present invention has the advantage of ease of assembly at the parts of the drill bit system. The parts can be assembled from above by sliding the splines 36 of the stub shank 32 into engagement with the splines 35 of the chuck 40 so that the shank fits within the chuck 4.

For simplicity the drill bit assembly of the present invention has been described in connection with a conventional down-the-hole hammer. However, the invention is equally applicable to a reverse circulation down-the-hole hammer as will be described with reference to FIGS. 12 to 14.

In a reverse circulation system, rock cuttings and debris are forced up through a hollow passageway or sample tube in the drill itself to the surface from the bottom face of the hole by the action of recirculated drilling fluid under pressure. The drilling fluid is circulated down an annular space inside the drill string. An advantage of the reverse circulation technique is that rock formations are continuously sampled as drilling proceeds, and a representative sample can be collected and monitored at the surface as sample is returned quickly from the bottom of the hole.

The reverse circulation down-the-hole hammer of the invention comprises an external cylindrical outer wear sleeve 105. An inner cylinder 125 is mounted co-axially within the outer wear sleeve 105. A sliding piston 108 is mounted for reciprocating movement within the inner cylinder and the outer wear sleeve 105, to strike a hammer bit 101 located at the forward end of the outer wear sleeve 105 to exercise a percussive force to the drill bit. The inner diameter of the wear sleeve 105 is such that an annular gap 170 is provided between the wear sleeve 105 and the inner cylinder 125.

According to the invention, the drill bit 101 is formed with an axially extending stub shank 132. The stub shank 132 is formed with a spline portion, provided with a plurality of axially extending splines 136. A hollow cylindrical chuck 104 is machined internally to provide a plurality of axially extending internal splines 135 on its internal wall which engage with the splines 136 of the shank 132 to transmit rotational drive from the chuck 104 to the drill bit. The splines 135, 136 are dimensioned to provide a number of fluid passageways 171 around the drill bit 101. The bit 101 may be retained in the chuck 104 using any of the arrangements described above in relation to the conventional hammer, i.e. part-annular bit retaining pieces, or ball nose pins.

Figures 12, 13, 14:
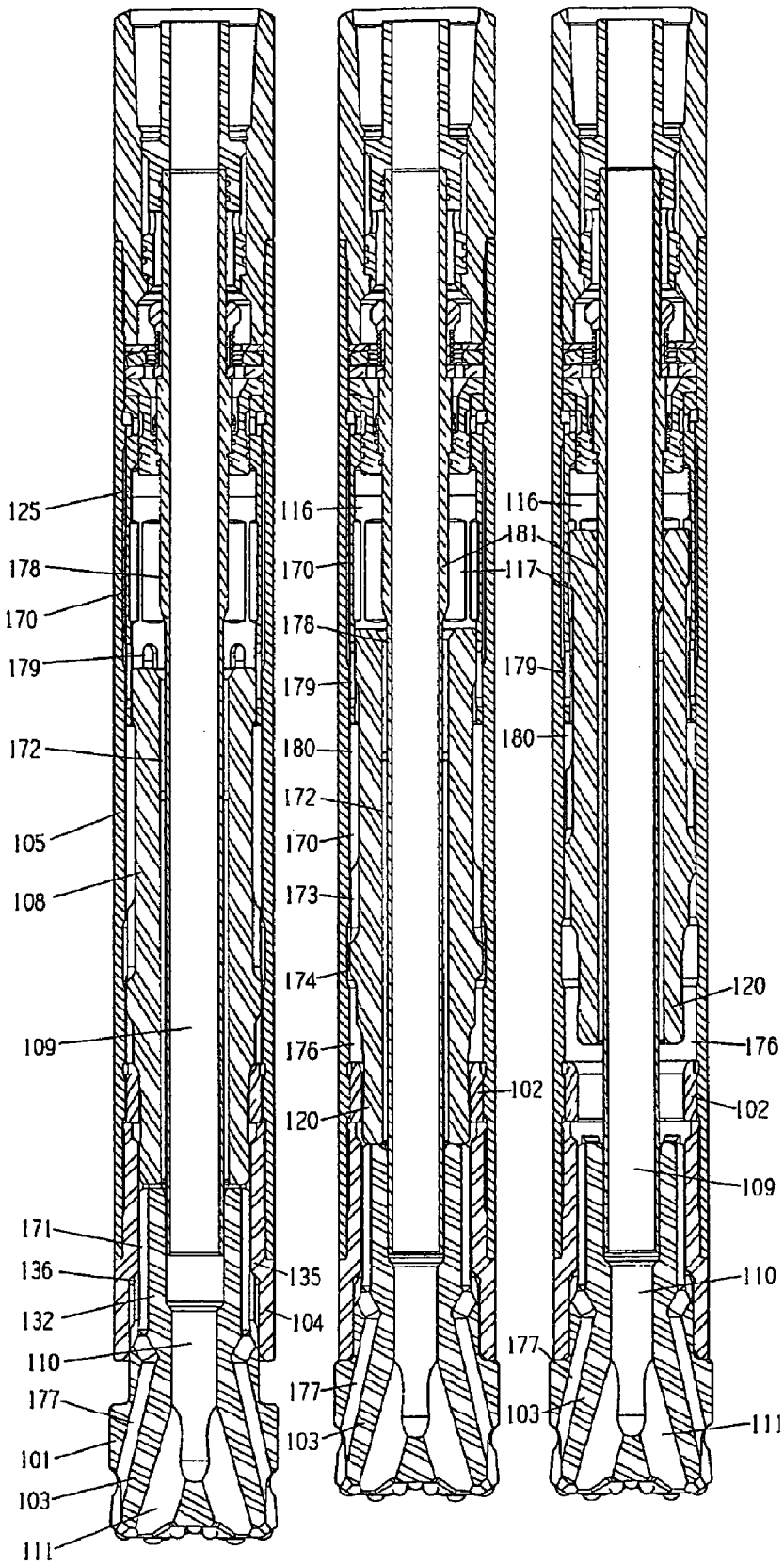
FIG. 12 is a sectional side elevation of a reverse circulation down-the-hole hammer according to the invention, showing the piston in an off-bottom position.
FIG. 13 is a sectional side elevation of the reverse circulation down-the-hole hammer of FIG. 12, showing the piston in the strike position.
FIG. 14 is a sectional side elevation of the reverse circulation down-the-hole hammer of FIG. 12, showing the piston at the top-of-stroke position.

FIG. 13 shows the hammer in the strike position, in which the piston nose 120 is in contact with the drill bit 101. At the beginning of the up or return stroke of the piston 108, chamber 116 communicates directly with the passageways 171 via an annular gap 172 around the central sample tube 178 to exhaust any pressure air. When pressurised air is supplied from annular gap 170 through inner cylinder ports 179, annular gap 180, piston grooves 173 and wear sleeve undercut 174, the chamber 176 is pressurised and an upward force is applied to the piston 108. As a result, the piston 108 lifts.

The upward movement continues until piston nose 120 moves out of contact with the bushing 102. FIG. 14 shows the piston 108 at the top of stroke. The pressurised fluid in chamber 176 may now exhaust through annular passageway 171 leading to groove 175 and then through the passageways 177 in the bit head 103. The main portion of the exhaust fluid enters the drilling space and is flushed through the return bores 111, 110, 109 to the surface collection apparatus. Chamber 116 is supplied with pressurised air through ports 179, annular gap 180 and grooves 117. Also annular gap 172 is sealed by piston 108 and enlarged diameter 181 on sample tube 178. As a result the piston is forced down to strike the bit and repeat the cycle.

The words "comprises/comprising" and the words "having/including" when used herein with reference to the present invention are used to specify the presence of stated features, integers, steps or components but does not preclude the presence or addition of one or more other features, integers, steps, components and groups thereof.

From the foregoing, it will be apparent that numerous modifications and variations can be effected without departing from the true spirit and scope of the novel concept of the present invention. It will be appreciated that the present disclosure is intended to set forth the exemplifications of the invention which are not intended to limit the invention to the specific embodiments illustrated. The disclosure is intended to cover by the appended claims all such modifications as fall within the scope of the claims.

Where technical features mentioned in any claim are followed by reference signs, these reference signs have been included for the sole purpose of increasing the intelligibility of the claims and accordingly, such reference signs do not have any limiting effect on the scope of each element identified by way of example by such reference signs.

The invention claimed is:

1. A drill bit assembly for fluid-operated percussion drill tools comprising: a percussion bit having a head portion formed with an axially extending stub shank; axially extending splines on the stub shank slideably engageable with complementary splines formed on a drive chuck whereby rotational drive from the chuck may be transmitted to the stub shank; bit retaining means at the chuck adapted for engagement with complementary retaining means at a spline portion of the stub shank to retain the stub shank in the drill bit assembly such that splined support for transfer of rotational torque is provided both above and below the bit retaining means; and engagement means on the chuck adapted for connecting the chuck to a drive means of the fluid-operated percussion drill tool, wherein the drive chuck is formed with a screw thread which is adapted to engage with a complementary screw thread on the lower end of a wear sleeve of the drill tool such that the bit retaining means are retained in the chuck; wherein the bit retaining means comprises at least one but preferably a plurality of apertures through the wall of the drive chuck and a corresponding plurality of bit retaining pieces; such that when the bit assembly is assembled, the bit retaining pieces are received in the apertures and engage with the complementary retaining means at the spline portion of the stub shank to retain the stub shank in the drill bit assembly and wherein the apertures are formed as part-annular slots through the wall of the drive chuck and the bit retaining pieces are part-annularly shaped and the complementary retaining means comprises annular shoulder; such that when the bit assembly is assembled, the part-annular bit retaining pieces are received in the part-annular slots and engage with the underside of the annular shoulder to retain the stub shank in the drill bit assembly.

2. A drill bit assembly as claimed in claim 1, wherein the axially extending splines are formed on an external cylindrical wall of the stub shank and engage with complementary splines formed internally of the drive chuck.

3. A drill bit assembly for fluid-operated percussion drill tools comprising: a percussion bit having a head portion formed with an axially extending stub shank; axially extending splines on the stub shank slideably engageable with complementary splines formed on a drive chuck whereby rotational drive from the chuck may be transmitted to the stub shank; bit retaining means at the chuck adapted for engagement with complementary retaining means at a spline portion of the stub shank to retain the stub shank in the drill bit assembly such that splined support for transfer of rotational tourque is provided both above and below the bit retaining means; and engagement means on the chuck adapted for connecting the chuck to a drive means of the fluid-operated percussion drill tool, wherein the drive chuck is formed with a screw thread which is adapted to engage with a complementary screw thread on the lower end of a wear sleeve of the drill tool such that the bit retaining means are retained in the chuck; wherein the bit retaining means comprises at least one, but preferably a plurality of apertures through the wall of the drive chuck and a corresponding plurality of bit retaining pieces; such that when the bit assembly is assembled, the bit retaining pieces are received in the apertures and engage with the complementary retaining means at the spline portion of the stub shank to retain the stub shank in the drill bit assembly; and wherein the apertures are formed as substantially circular openings through the wall of the drive chuck and the bit retaining pieces are ball nose pins, and the complementary retaining means comprises a plurality of recesses formed at an upper end of the stub shank; such that when the bit assembly is assembled, the ball nose pins are received in the circular openings and engage with upper internal walls of the recesses to retain the stub shank in the drill bit assembly.

4. A drill bit assembly as claimed in claim 3, wherein at least one of the recesses at the upper end of the stub shank is formed entirely within a spline on the stub shank.

5. A drill bit assembly as claimed in claim 4, wherein each recess at the upper end of the stub shank is formed entirely within a respective one of the splines on the stub shank.

6. A drill bit assembly as claimed in claim 3, wherein the axially extending splines are formed on an external cylindrical wall of the stub shank and engage with complementary splines formed internally of the drive chuck.

7. A down-the-hole hammer comprising an external cylindrical outer wear sleeve, a sliding piston mounted for reciprocating movement within the outer wear sleeve to strike a percussion bit of a drill bit assembly located at the forward end of the outer wear sleeve wherein the drill bit assembly is an assembly as claimed in any one of the preceding claims.

8. A down-the-hole hammer as claimed in claim 7, wherein the hammer is a reverse circulation down-the-hole hammer.

* * * * *